US006994483B2

(12) United States Patent
Jang

(10) Patent No.: US 6,994,483 B2
(45) Date of Patent: Feb. 7, 2006

(54) PAPER SUPPLY CASSETTE OF PRINTER

(75) Inventor: Kyung-hwan Jang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 102 days.

(21) Appl. No.: 10/334,123

(22) Filed: Dec. 31, 2002

(65) Prior Publication Data

US 2003/0223801 A1 Dec. 4, 2003

(30) Foreign Application Priority Data

Jun. 1, 2002 (KR) ..... 10-2002-0030890

(51) Int. Cl.
*B65H 1/04* (2006.01)
*B65H 1/00* (2006.01)
*B41J 29/02* (2006.01)

(52) U.S. Cl. ..... 400/629; 400/624; 271/145; 271/147

(58) Field of Classification Search ..... 400/624, 400/625, 628, 629; 399/393; 271/258.05, 271/145, 162
See application file for complete search history.

(56) References Cited

U.S. PATENT DOCUMENTS 4,853,712 A * 8/1989 Piatt ..... 346/134
5,895,038 A * 4/1999 Takashima ..... 271/114
6,244,588 B1 * 6/2001 Tsubakimoto et al. ..... 271/164

FOREIGN PATENT DOCUMENTS

| | | | |
|---|---|---|---|
| JP | 06-138721 | | 5/1994 |
| JP | 07276720 | A * | 10/1995 |
| JP | 09058883 | A * | 3/1997 |
| JP | 2000330347 | A * | 11/2000 |
| JP | 2001019181 | A * | 1/2001 |
| KR | 0074818 | | 3/1994 |

OTHER PUBLICATIONS

Machine translation of JP 2000330347 to Tamehira et al. from the Japanese Patent Office website.*
Machine translation of JP 2001019181 to Miyazaki from the Japanese Patent Office website.*

* cited by examiner

*Primary Examiner*—Daniel J. Colilla
(74) *Attorney, Agent, or Firm*—Staas & Halsey LLP

(57) ABSTRACT

A paper supply cassette includes a main body to which a paper supply roller is coupled, a container provided to slid e into/from the main body, a first lever installed at the main body to swing, a first gear installed at one side of the first lever to rotate and drive a paper supply roller by being meshed with a drive gear provided at the printer, a first elastic member to apply an elastic force to the first lever in a direction in which the first gear is meshed with the drive gear, and a locking unit to selectively lock the first lever in a state in which the first gear is separated from the drive gear. Thus, the damage to or deformation of the first gear of the paper supply cassette is prevented. Also, since the paper is stably supplied, the quality of an image can be improved.

10 Claims, 4 Drawing Sheets

PAPER SUPPLY CASSETTE OF PRINTER

CROSS-REFERENCE TO RELATED APPLICATIONS

This application claims the benefit of Korean Application No. 2002-30890, filed Jun. 1, 2002, in the Korean Intellectual Property Office, the disclosure of which is incorporated herein by reference.

BACKGROUND OF THE INVENTION

1. Field of the Invention

The present invention relates to a paper cassette that may be installed in a printer, and more particularly, to a paper supply cassette to supply paper loaded therein to the printer by receiving a driving force from the printer.

2. Description of the Related Art

In general, a printer has a paper supply device which contains and supplies paper to a printing portion. Paper supply devices can be classified into multi-purpose paper supply devices integrally placed within the printer, and paper supply cassettes. In particular, a large capacity printer is typically designed to be capable of using one or more paper supply cassettes.

When the paper supply cassette is installed in the printer, it is common that a driving apparatus to supply paper is provided at the printer while only the cassette containing paper is installed to slide into/from the printer. However, when the paper supply cassette is to be optionally installed in the printer, a driving motor is separately installed at the paper supply cassette or the paper supply cassette is driven by a gear connection mechanism with the printer.

FIG. 1 is a view illustrating a conventional printer having a paper supply cassette. As shown in FIG. 1, a paper supply cassette 110 is coupled at a lower portion of a printer 100. A drive gear 120 meshed with a driving motor (not shown) is provided at the lower portion of the printer 100.

The paper supply cassette 110 includes a main body 130 coupled to the printer 100 and a container 170 where paper S is loaded. The container 170 is coupled to the main body 130 to slide along the direction A of FIG. 1.

In the main body 130, there is a paper supply roller 140 to supply the paper S to the printer 100 while rotating in contact with the paper S loaded in the container 170, and a driven gear 150 engaged with the drive gear 120 and to transfer a rotational force of the drive gear 120 to the paper supply roller 140.

When the paper supply cassette 110 is coupled to the lower portion of the printer 100, since the drive gear 120 and the driven gear 150 are meshed with each other to transmit power, the rotational force of the drive gear 120 is transferred to the paper supply roller 140 via the driven gear 150. Thus, when the drive gear 120 rotates, the paper supply roller 140 rotates so that the paper S loaded in the container 170 is supplied to the printer 100.

The printer 100 may use only a paper supply cassette (not shown) installed within the printer or a multi-purpose paper supply device 160, without additionally installing the paper supply cassette 110. Thus, the drive gear 120 to transmit power to the additionally installed paper supply cassette 110 is typically installed inside the printer 100 to be separated a predetermined distance upward from the lower surface of the printer 100. This is because, if the drive gear 120 is installed to protrude downward from the lower surface of the printer 100, the drive gear 120 can interfere with a table (not shown) when the printer 100 is placed on the table for use.

Thus, for the driven gear 150 installed at the main body 130 of the paper supply cassette 110 to be engaged with the drive gear 120, the driven gear 150 should be installed to protrude a predetermined height upward from the upper surface of the paper supply cassette 110.

When the driven gear 150 protrudes upward from the upper surface of the paper supply cassette 110, careful attention is needed when the paper supply cassette 110 is carried or installed at the printer 100. This is because a tooth profile of the driven gear 150 may be damaged or a gear shaft can be bent by an external impact. Such a damaged tooth profile or deformed gear shaft may cause noise during the supply of paper, or malfunction of the paper supply. Furthermore, in some cases, connection with the drive gear 120 is not possible.

SUMMARY OF THE INVENTION

Accordingly, it is an aspect of the present invention to provide an improved paper supply cassette in which a driven gear of the paper supply cassette connected to a drive gear installed in the printer does not protrude from the upper surface of the paper supply cassette so that damage to a tooth profile and deformation of the gear shaft can be prevented.

Additional aspects and advantages of the invention will be set forth in part in the description which follows and, in part, will be obvious from the description, or may be learned by practice of the invention.

The foregoing and/or other aspects of the present invention may be achieved by providing a paper supply cassette to supply paper to a printer, including a paper supply roller, a main body to which the paper supply roller is coupled, a container to slid e into/from the main body, a first lever installed at the main body to swing, a drive gear, a first gear installed at a side of the first lever to rotate and drive a paper supply roller by being meshed with the drive gear, a first elastic member to apply a first elastic force to the first lever in a direction in which the first gear is meshed with the drive gear, and a locking unit to selectively lock the first lever in a state in which the first gear is separated from the drive gear.

The paper supply cassette may further include a first stopper to restrict a swing angle of the first lever caused by the elastic force.

The locking may include a first hook provided at the first lever, and a second lever provided at the main body to swing, and having a second hook selectively coupled to the first hook. The second lever further including a releasing portion which interferes with the printer and swings in a direction in which the second hook is released from the first hook by interference between the releasing portion and the printer, when the paper supply cassette is installed in the printer.

The locking unit may further include a second elastic member to apply a second elastic force to the second lever in a direction in which the second hook is coupled to the first hook. The locking unit further includes a stopper to restrict a swinging angle of the second lever caused by the second elastic force.

According to the above structure, when the paper supply cassette is not installed in the printer, the first gear is disposed under the upper surface of the paper supply cassette and then, when the paper supply cassette is installed in the printer, the first gear protrudes above the upper surface of the paper supply cassette to be connected to the drive gear.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
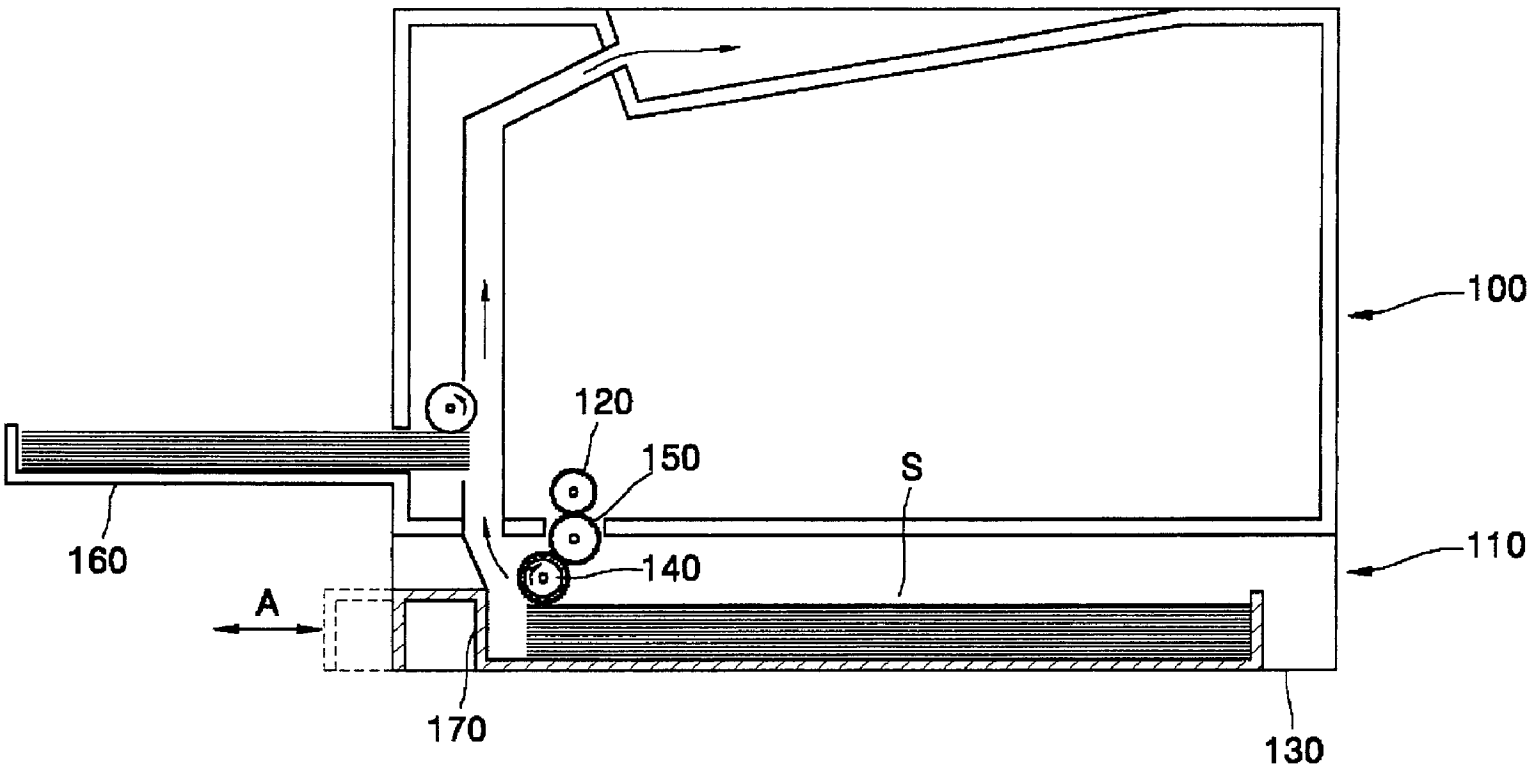
FIG. 1 (PRIOR ART)
FIG. 1 is a view illustrating a printer adopting a conventional paper supply cassette.

Reference will now be made in detail to the present preferred embodiments of the present invention, examples of which are illustrated in the accompanying drawings, wherein like reference numerals refer to like elements throughout. The embodiments are described below in order to explain the present invention by referring to the figures.

Figure 2:
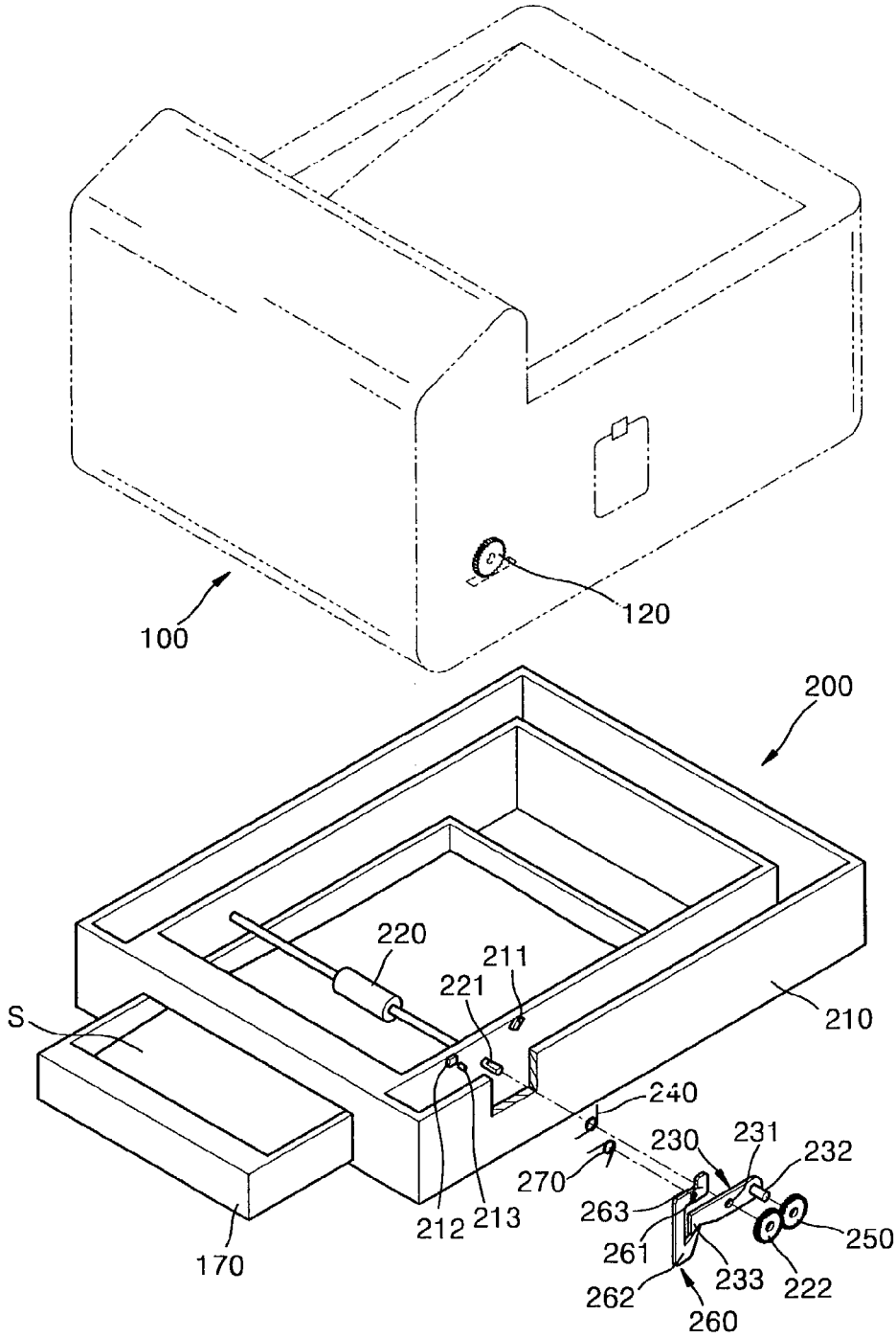
FIG. 2 is an exploded perspective view illustrating a paper supply cassette according to a first embodiment of the present invention.

Referring to FIG. 2, the container 170 containing the paper S and a paper supply roller 220 to supply the paper S to the printer 100 are provided at a main body 210 of a paper supply cassette 200. The drive gear 120 is installed inside the printer 100 to be separated a predetermined distance upward from the lower surface of the printer 100.

A first lever 230, a first elastic member 240, a first gear 250, a second lever 260, and a second elastic member 270 are coupled to one side of the main body 210. A first stopper 211 and a second stopper 212 restricting rotation angles of the first and second levers 230 and 260, respectively, are provided in the main body 210.

The first lever 230 is formed to extend from a first hinge portion 231 in opposite directions. The first hinge portion 231 is installed so that the first lever 230 can swing up and down by being inserted around a shaft 221 of the paper supply roller 220. The first gear 250 is rotatably installed on a shaft 232 that is provided at one side of the first lever 230. To drive the paper supply roller 220, the first gear 250 is engaged with a second gear 222 coupled to the shaft 221 of the paper supply roller 220. A first hook 233 is provided at the other side of the first lever 230. The first lever 230 may be coupled to a shaft (not shown) provided at the main body 210, via a hole in the first hinge 231, and the first gear 250 may be connected to the second gear 222 via a gear train (not shown).

The first elastic member 240 provides an elastic force to the first lever 230 to swing around the first hinge portion 231 in a direction in which the first gear 250 and the drive gear 120 are engaged with each other. In FIG. 2, a torsion spring is used as the first elastic member 240. However, a compression coil spring or an extension coil spring may also be used.

The first stopper 211 is provided at the main body 210 and contacts the first lever 230 to prevent the first lever 230 from excessively rotating toward the drive gear 120 by an elastic force of the first elastic member 240. Thus, the first stopper 211 may be provided to contact the first lever 230 at a position where a distance between the axes of the first gear 250 and the drive gear 120 can be maintained.

However, for example, in the case in which a torsion spring is used as the first elastic member 240, when the torsion spring is in a free state without deformation when the first lever 230 is disposed at a position where the first gear 250 and the drive gear 120 are connected, the first lever 230 can be prevented from excessively rotating toward the drive gear 120 by the elastic force of the first elastic member 240, without the first stopper 211.

The second lever 260 extends in opposite directions from a second hinge portion 261. The second hinge portion 261 is coupled to a shaft 213 of the main body 210 to be capable of swinging up and down. A second hook 262 coupled to the first hook 233 of the first lever 230 is provided at one side of the second lever 260. When the first gear 250 is separated from the drive gear 120, the second hook 262 is coupled to the first hook 233 of the first lever 230. A releasing portion 263 is provided at the other side of the second lever 260. The releasing portion 263 may be formed not to protrude from the upper surface of the paper supply cassette 200. Also, the second hook 262 and the first hook 233 may be provided directly under the second hinge portion 261.

The second elastic member 270 applies an elastic force so that the second lever 260 can rotate in a direction in which the second hook 262 is coupled to the first hook 233 of the first lever 230. In the present embodiment, an elastic force is applied in a direction in which the second hook 262 is pushed toward the first hook 233 by using a torsion spring.

The second stopper 212 is provided at the main body 210 to prevent the second lever 260 from excessively rotating in a direction in which the second elastic member 270 applies the elastic force, when the second hook 262 is released from the first hook 233. Thus, the position of the second stopper 212 may be determined such that the second lever 260 rotates slightly more than at the position where the second hook 262 and the first hook 233 are coupled by the elastic force of the second elastic member 270.

However, for example, when a torsion spring is used as the second elastic member 270, if the torsion spring reaches a free state, without deformation, when the second lever 260 is disposed at a position where the second lever 260 rotates slightly more than at the position where the second hook 262 and the first hook 233 are coupled, the second lever 260 can be prevented from excessively rotating in a direction in which the second elastic member 270 applies an elastic force, without the second stopper 212.

The first lever 230, the first elastic member 240, the first gear 250, the second lever 260, and the second elastic member 270 can be coupled to the main body 210 of the paper supply cassette 200 after being assembled in an additional bracket (not shown).

Figure 3:
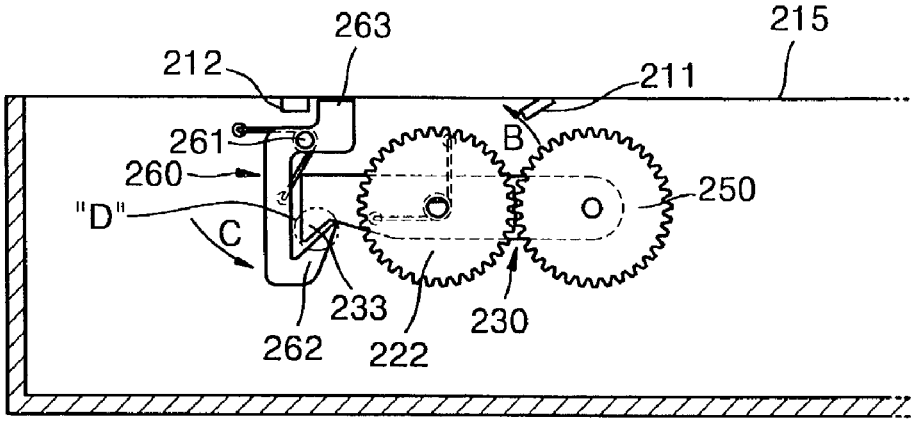
FIGS. 3 and 4 are views illustrating the locking and unlocking states of the paper supply cassette shown in FIG. 2.
Figure 4:
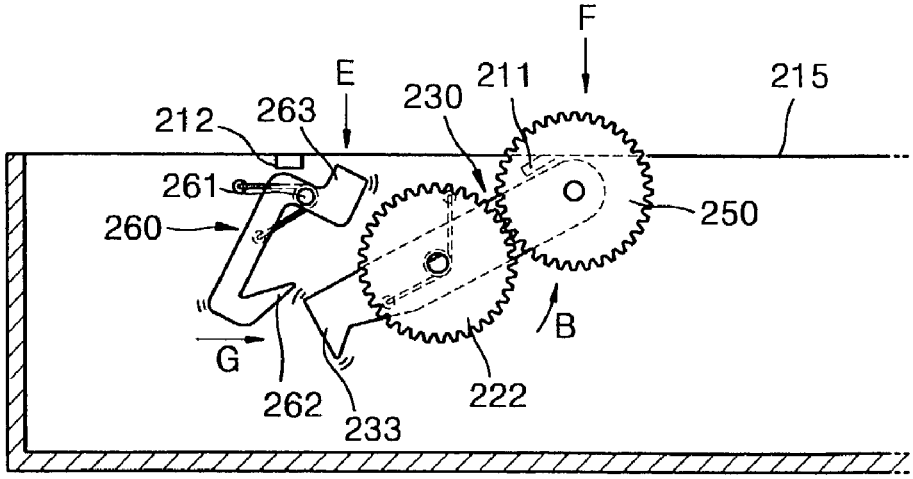

The operation of the paper supply cassette having the structure of FIG. 2 will now be described with respect to FIGS. 3 and 4. FIGS. 3 and 4 are views respectively showing the locked and unlocked states of the paper supply cassette according to the first embodiment of the present invention.

First, referring to FIG. 3, the first hook 233 of the first lever 230 is coupled to the second hook 262 of the second lever 260 so that the first lever 230 is locked. The first gear 250 is disposed under an upper surface 215 of the paper supply cassette 200. Here, the elastic force of the first elastic member 240 is applied to the first lever 230 to make the first lever 230 rotate in a direction B. The elastic force of the second elastic member 270 is applied to the second lever 260 to make the second lever 260 rotate in a direction C.

The second hook 262 and the first hook 233 are provided directly under the second hinge portion 261. Also, since a contact portion between the second hook 262 and the first hook 233 is formed to be inclined in a direction in which they are coupled together, as indicated by a portion "D" of FIG. 3, without the second elastic member 270, a locking state is not released by an impact.

In the present embodiment, since the second elastic member 270 is further provided, the locking state is maintained unless it is not intentionally released.

Thus, when the paper supply cassette 200 is carried in the state shown in FIG. 3, since the first gear 250 is disposed under the upper surface 215 of the paper supply cassette 200, damage to a tooth profile of the first gear 250 or deformation of the gear shaft by an external impact does not occur.

To install the paper supply cassette 200 in the printer 100, the first lever 230 should be rotated in the direction B so that the first gear 250 and the drive gear 120 are connected. For this purpose, the releasing portion 263 of the second lever 260 is pushed in a direction E, as shown in FIG. 4, so that the second hook 262 is released from the first hook 233. Then, the first lever 230 is rotated in the direction B by the elastic force of the first elastic member 240 and the first gear 250 moves up from the upper surface 215 of the cassette 200.

Here, the first lever 230 is stopped by the first stopper 211 at the position where the distance between the axes of the drive gear 120 and the first gear 250 are maintained. Also, the second lever 260 is stopped by the second stopper 212 in a state in which the second lever 260 rotates slightly more than at a position where the second hook 262 and the first hook 233 are coupled.

In this state, when the paper supply cassette 200 is coupled to the printer 100, the drive gear 120 and the first gear 250 are engaged so that the rotational force of the drive gear 120 can be transferred to the paper supply roller 220.

When the paper supply cassette 200 is installed at the printer 100, even when the drive gear 120 collides against the first gear 250, the first lever 230 is initially pushed in a direction F. However, the first lever 230 is rotated back in the direction B by the elastic force of the first elastic member 240 to push the first gear 250 toward the drive gear 120 so that an impact can be reduced and damage to the tooth profile can be prevented.

In contrast, when the paper supply cassette 200 is separated from the printer 100, by slightly pressing the first gear 250 in the direction F, the second hook 262 of the second lever 260 is coupled to the first hook 233 of the first lever 230 by the elastic force of the second elastic member 270, so that the first lever 230 is locked. In the case in which the second elastic member 270 is not provided, by pushing the second hook 262 in a direction G while slightly pressing the first gear 250 in the direction F, the second hook 262 is coupled to the first hook 233 to lock the first lever 230. Then, the paper supply cassette 200 is carried or kept in the state shown in FIG. 3.

Figure 5:
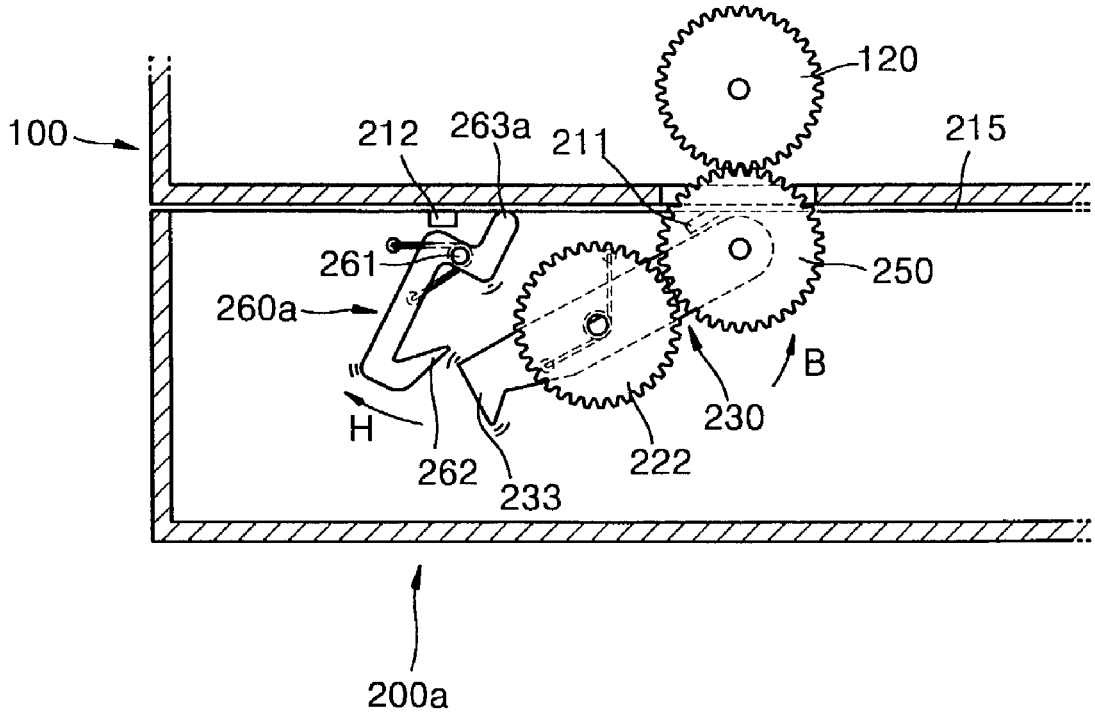
FIG. 5 is a view illustrating a paper supply cassette according to a second embodiment of the present invention.

FIG. 5 shows a second embodiment of a paper supply cassette according to the present invention.

As shown in the drawing, a releasing portion 263*a* of a second lever 260*a* extends upward to protrude above the upper surface 215 of a paper supply cassette 200*a*. According to the above structure, when the paper supply cassette 200*a* is installed under the printer 100, as the bottom surface of the printer 100 contacts the releasing portion 263*a*, the second lever 260*a* is rotated in a direction H. Then, the first hook 233 of the first lever 230 is released from the second hook 262 of the second lever 260*a* and the first lever 230 is rotated in the direction B by the elastic force of the first elastic member 240. Thus, the first gear 250 is engaged with the drive gear 120 so that the rotational force of the drive gear 120 is transferred to the paper supply roller 220. That is, according to the structure shown in FIG. 5, unlocking the first lever 230 before the paper supply cassette 200 is installed, as shown in FIG. 4, is not necessary.

In the above-described embodiments, the paper supply cassette is installed at the lower portion of the printer, that is, the printer includes only a multi-purpose paper supply apparatus without a lower end paper supply cassette. However, the present invention is not limited to these embodiments so that when a first paper supply cassette is installed at the lower end of the printer, if the drive gear to transmit power is installed at the first paper supply cassette, the paper supply cassette can be additionally installed at the lower end of the first paper supply cassette.

According to the above-described paper supply cassette, since the first gear, locked in a position lower than the upper surface of the paper supply cassette, is released and protrudes above the upper surface of the paper supply cassette only when the paper supply cassette is installed at the printer, during carrying or installation of the paper supply cassette, damage to a tooth profile of the gear or deformation of the gear shaft by an external impact can be prevented. Thus, generation of noise due to the damaged tooth profile or deformed gear shaft can be prevented. Furthermore, the paper is stably supplied so that quality of an image can be improved.

Also, since the first gear of the paper supply cassette is elastically engaged with the drive gear of the printer, the damage to the first gear or the drive gear by an impact during the installation of the paper supply cassette is prevented.

Although a few preferred embodiments of the present invention have been shown and described, it would be appreciated by those skilled in the art that changes may be made without departing from the principles and spirit of the invention, the scope of which is defined in the claims and their equivalents.

What is claimed is:

1. A paper supply cassette to supply paper to a printer comprising a drive gear, the cassette comprising:

a paper supply roller;

a main body to which the paper supply roller is coupled;

a container to slide into/from the main body;

a first lever installed at the main body to swing;

a first gear installed at a side of the first lever to rotate and drive the paper supply roller by being meshed with the drive gear;

a first elastic member to apply a first elastic force to the first lever in a direction in which the first gear is meshed with the drive gear; and a locking unit to selectively lock the first lever in a state in which the first gear is separated from the drive gear.

2. The paper supply cassette as claimed in claim 1, further comprising a stopper to restrict a swinging angle of the first lever caused by the first elastic force.

3. The paper supply cassette as claimed in claim 1, wherein the locking unit comprises:

a first hook provided at the first lever; and a second lever provided at the main body to swing, and having a second hook selectively coupled to the first hook.

4. The paper supply cassette as claimed in claim 3, wherein the locking unit further comprises a second elastic member to apply a second elastic force to the second lever in a direction in which the second hook is coupled to the first hook.

5. The paper supply cassette as claimed in claim 4, wherein the locking unit further comprises a stopper to restrict an angle of the second lever caused by the second elastic force.

6. The paper supply cassette as claimed in claim 3, wherein the second lever comprises a releasing portion, which interferes with the printer, and swings in a direction in which the second hook is released from the first hook by interference between the releasing portion and the printer when the paper supply cassette is installed in the printer.

7. An apparatus to supply paper to a printer, comprising:

a cassette to store the paper and having a surface;

a drive roller, to move the paper, on a first side of the surface of the cassette;

a first transfer gear to transfer a power to the drive roller;

a lever to move the first transfer gear between a first position entirely on the first side of the surface of the cassette, and a second position, partially on the first side of the surface of the cassette; and a bias unit to bias the lever towards the second position.

8. The apparatus as claimed in claim 7, further comprising:

a drive gear on a second side of the surface of the cassette, opposite the first side, the drive gear to drive the first transfer gear when the first transfer gear is in the second position.

9. The apparatus as claimed in claim 8, wherein the drive roller comprises a shaft, the apparatus further comprising:

a second transfer gear attached to the shaft of the drive roller and meshed with the first transfer gear, to receive the power from the first transfer gear.

10. The apparatus as claimed in claim 7, wherein the first transfer gear comprises a plurality of teeth disposed entirely on the first side of the surface of the cassette when the first transfer gear is in the first position.

* * * * *

UNITED STATES PATENT AND TRADEMARK OFFICE

CERTIFICATE OF CORRECTION

PATENT NO. : 6,994,483 B2
APPLICATION NO. : 10/334123
DATED : February 7, 2006
INVENTOR(S) : Kyung-hwan Jang It is certified that error appears in the above-identified patent and that said Letters Patent is hereby corrected as shown below:

On the Front Page: Column 2, line 2, (Foreign Patent Documents), after "10/1995" insert --B41J/11/00--;

Column 2, line 3, (Foreign Patent Documents), after "3/1997", insert --B65H/03/00--;

Column 2, line 4, (Foreign Patent Documents), after "11/2000", insert --G03G/15/00--;

Column 2, line 5, (Foreign Patent Documents), after "01/2001", insert --B65H/01/26--;

Column 2, lines 2-3, (Abstract), replace "slid e", insert --slide--; therefor.

Signed and Sealed this

Eleventh Day of July, 2006

JON W. DUDAS
*Director of the United States Patent and Trademark Office*